US006076206A

United States Patent [19]

Celaya

[11] Patent Number: 6,076,206

[45] Date of Patent: Jun. 20, 2000

[54] MEDICAL TRANSPORT COT COLLAPSIBLE CANOPY SYSTEM

[76] Inventor: Timothy A. Celaya, 6517 N. 74th Dr., Glendale, Ariz. 85303

[21] Appl. No.: 09/205,744

[22] Filed: Dec. 4, 1998

[51] Int. Cl.[7] ..... A47C 29/00

[52] U.S. Cl. ..... 5/414; 5/629; 5/113; 135/106; 135/119

[58] Field of Search ..... 5/113, 629, 414, 5/416; 297/184.1, 184.11, 184.17; 135/106, 119

[56] References Cited

U.S. PATENT DOCUMENTS

| | | | |
|---|---|---|---|
| 1,805,415 | 5/1931 | Pendarvis et al. . | |
| 2,191,024 | 2/1940 | Matheny | 135/5.2 |
| 2,694,403 | 11/1954 | Hudson | 135/5.1 |
| 4,093,305 | 6/1978 | Staroste et al. | 5/113 X |
| 4,232,692 | 11/1980 | Atkins | 135/5.1 |
| 4,810,030 | 3/1989 | Lewis | 297/184 |
| 4,830,037 | 5/1989 | Held | 135/88 |
| 4,846,204 | 7/1989 | Sok Kyu | 135/106 |
| 4,914,768 | 4/1990 | Howard | 5/113 |
| 4,937,903 | 7/1990 | Joly et al. | 5/414 |
| 4,939,803 | 7/1990 | Waters | 5/414 |
| 4,978,166 | 12/1990 | James | 297/184.17 |
| 5,320,405 | 6/1994 | Foster et al. | 297/184 |
| 5,511,259 | 4/1996 | Tarara | 5/414 |
| 5,551,745 | 9/1996 | Huang | 297/184.17 X |

*Primary Examiner*—Michael F. Trettel
*Attorney, Agent, or Firm*—Joseph N. Breaux

[57] ABSTRACT

A collapsible canopy system that is attachable to a medical transport cot. The collapsible canopy system includes a canopy assembly that is storable in a collapsed configuration and extendable when desired to partially or fully cover the head rest portion of the medical transport cot to partially or fully shield the face area of a patient being transported on the medical transport cot. The canopy assembly is adjustable in size to accommodate different sized patients. The canopy assembly also has a rapidly replaceable canopy member.

1 Claim, 4 Drawing Sheets

MEDICAL TRANSPORT COT COLLAPSIBLE CANOPY SYSTEM

TECHNICAL FIELD

The present invention relates to medical transportation equipment and more particularly to a medical transport cot collapsible canopy system that includes two cot rail connecting mechanisms, each installable in connection with a bottom side rail of a medical transport cot, and a canopy assembly that is extendable from a collapsed configuration to provide a shield over a head rest portion of the medical transport cot; the canopy assembly including three extendable length, U-shaped canopy supports, a stretchable fabric canopy member, and three canopy member securing strips; each of the three U-shaped canopy supports having a U-shaped cross bar portion including a cross portion and two parallel oriented tubular end portions and two extendable length arms that are each slidably positionable into one of the two tubular end portions and lockable with respect thereto with a locking pin; each of the two extendable length arms terminating in a washer shaped fitting that is rotatably connected to the washer shaped fittings of the corresponding extendable length arms of the other two U-shaped canopy supports with a locking bolt assembly that includes a locking bolt having a shaft positionable through the washer shaped fittings and a nut threaded onto the shaft and tightenable sufficiently to lock the washer shaped fittings in fixed relation to each other; the stretchable fabric canopy member being constructed from a stretchable material and including three spaced hook and pile fastener strip pairs provided on the exterior surface thereof such that the U-shaped cross bar portion of each of the U-shaped canopy supports is positionable between one of the spaced hook and pile fastener strip pairs and securable in place with one of three canopy securing strips; each of the canopy securing strips having companionate hook and pile fastener strips provided along the side edges thereof that connect with the hook and pile fastener strips of the three spaced hook and pile fastener strip pairs such that each of the three canopy securing strips forms a canopy support receiving sleeve when connected to a hook and pile fastener strip pair; each of the two cot rail attachment mechanisms having a cot rail connecting mechanism in connection with a flat connecting plate; each cot rail connecting mechanism having a rail locking screw extendable into a rail receiving channel of the cot rail connecting mechanism for locking the cot rail attachment mechanism in a user selected position along a cot rail; the flat connecting plate being rotatably connected to the canopy assembly with the locking bolt assembly.

BACKGROUND ART

The face area of patients being transported on medical transport cots from accident scenes, particularly when air transport is to be used, are subject to exposure to harmful elements such as rain, flashing lights, and wind blown sand, stones and other debris. It would be a benefit, therefore, to have a collapsible canopy system that was attachable to a medical transport cot that could be stored in a collapsed configuration and extended when desired to partially or fully cover the head rest portion of the medical transport cot to partially or fully protect the face area of the patient as conditions require. To accommodate different sized patients, it would be a further benefit to have a collapsible canopy system that was attachable to a medical transport cot that included a canopy assembly that was adjustable in size. Because medical transport cots often need to be rapidly refitted for use with another patient, it would be a further benefit to have such a collapsible canopy system that included a canopy assembly having a rapidly replaceable canopy member.

GENERAL SUMMARY DISCUSSION OF INVENTION

It is thus an object of the invention to provide a collapsible canopy system that is attachable to a medical transport cot and that is storable in a collapsed configuration and extendable when desired to partially or fully cover the head rest portion of the medical transport cot.

It is a further object of the invention to provide a medical transport cot collapsible canopy system that includes a canopy assembly that is adjustable in size.

It is a still further object of the invention to provide a medical transport cot collapsible canopy system that includes a canopy assembly having a rapidly replaceable canopy member.

It is a still further object of the invention to provide a medical transport cot collapsible canopy system that includes two cot rail connecting mechanisms, each installable in connection with a bottom side rail of a medical transport cot, and a canopy assembly that is extendable from a collapsed configuration to provide a shield over a head rest portion of the medical transport cot; the canopy assembly including three extendable length, U-shaped canopy supports, a stretchable fabric canopy member, and three canopy member securing strips; each of the three U-shaped canopy supports having a U-shaped cross bar portion including a cross portion and two parallel oriented tubular end portions and two extendable length arms that are each slidably positionable into one of the two tubular end portions and lockable with respect thereto with a locking pin; each of the two extendable length arms terminating in a washer shaped fitting that is rotatably connected to the washer shaped fittings of the corresponding extendable length arms of the other two U-shaped canopy supports with a locking bolt assembly that includes a locking bolt having a shaft positionable through the washer shaped fittings and a nut threaded onto the shaft and tightenable sufficiently to lock the washer shaped fittings in fixed relation to each other; the stretchable fabric canopy member being constructed from a stretchable material and including three spaced hook and pile fastener strip pairs provided on the exterior surface thereof such that the U-shaped cross bar portion of each of the U-shaped canopy supports is positionable between one of the spaced hook and pile fastener strip pairs and securable in place with one of three canopy securing strips; each of the canopy securing strips having companionate hook and pile fastener strips provided along the side edges thereof that connect with the hook and pile fastener strips of the three spaced hook and pile fastener strip pairs such that each of the three canopy securing strips forms a canopy support receiving sleeve when connected to a hook and pile fastener strip pair; each of the two cot rail attachment mechanisms having a cot rail connecting mechanism in connection with a flat connecting plate; each cot rail connecting mechanism having a rail locking screw extendable into a rail receiving channel of the cot rail connecting mechanism for locking the cot rail attachment mechanism in a user selected position along a cot rail; the flat connecting plate being rotatably connected to the canopy assembly with the locking bolt assembly.

It is a still further object of the invention to provide a medical transport cot collapsible canopy system that accomplishes all or some of the above objects in combination.

Accordingly, a medical transport cot collapsible canopy system is provided. The medical transport cot collapsible canopy system includes two cot rail connecting mechanisms, each installable in connection with a bottom side rail of a medical transport cot, and a canopy assembly that is extendable from a collapsed configuration to provide a shield over a head rest portion of the medical transport cot; the canopy assembly including three extendable length, U-shaped canopy supports, a stretchable fabric canopy member, and three canopy member securing strips; each of the three U-shaped canopy supports having a U-shaped cross bar portion including a cross portion and two parallel oriented tubular end portions and two extendable length arms that are each slidably positionable into one of the two tubular end portions and lockable with respect thereto with a locking pin; each of the two extendable length arms terminating in a washer shaped fitting that is rotatably connected to the washer shaped fittings of the corresponding extendable length arms of the other two U-shaped canopy supports with a locking bolt assembly that includes a locking bolt having a shaft positionable through the washer shaped fittings and a nut threaded onto the shaft and tightenable sufficiently to lock the washer shaped fittings in fixed relation to each other; the stretchable fabric canopy member being constructed from a stretchable material and including three spaced hook and pile fastener strip pairs provided on the exterior surface thereof such that the U-shaped cross bar portion of each of the U-shaped canopy supports is positionable between one of the spaced hook and pile fastener strip pairs and securable in place with one of three canopy securing strips; each of the canopy securing strips having companionate hook and pile fastener strips provided along the side edges thereof that connect with the hook and pile fastener strips of the three spaced hook and pile fastener strip pairs such that each of the three canopy securing strips forms a canopy support receiving sleeve when connected to a hook and pile fastener strip pair; each of the two cot rail attachment mechanisms having a cot rail connecting mechanism in connection with a flat connecting plate; each cot rail connecting mechanism having a rail locking screw extendable into a rail receiving channel of the cot rail connecting mechanism for locking the cot rail attachment mechanism in a user selected position along a cot rail; the flat connecting plate being rotatably connected to the canopy assembly with the locking bolt assembly.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
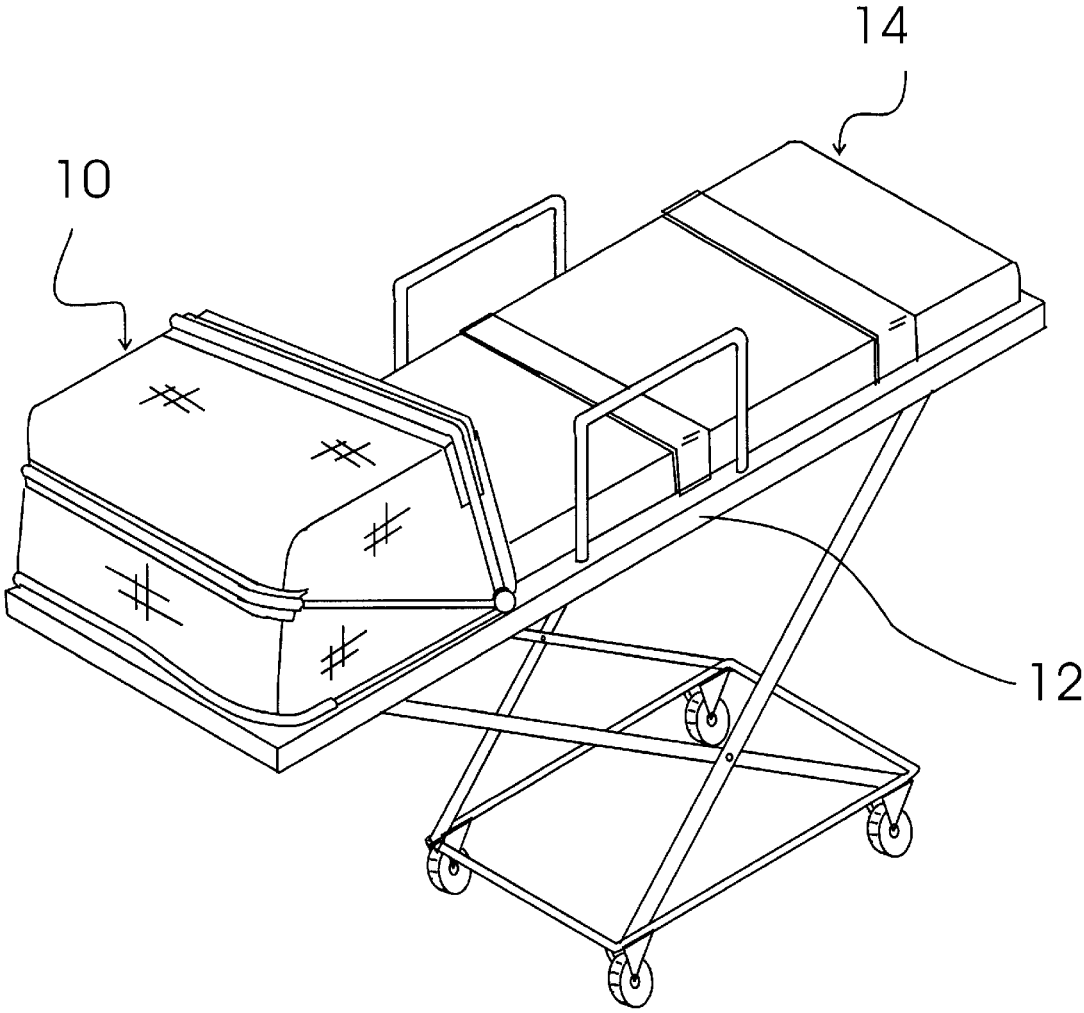
FIG. 1 is a perspective view of an exemplary embodiment of the medical transport cot collapsible canopy system of the present invention installed in connection with the bottom side rails of a representative medical transport cot with the canopy assembly in the partially extended configuration partially shielding the head rest portion of the medical transport cot.

FIG. 1 shows an exemplary embodiment of the medical transport cot collapsible canopy system of the present invention, generally designated 10, installed in connection with the parallel bottom side rails 12 (only one shown) of a representative medical transport cot, generally designated 14.

Figure 2:
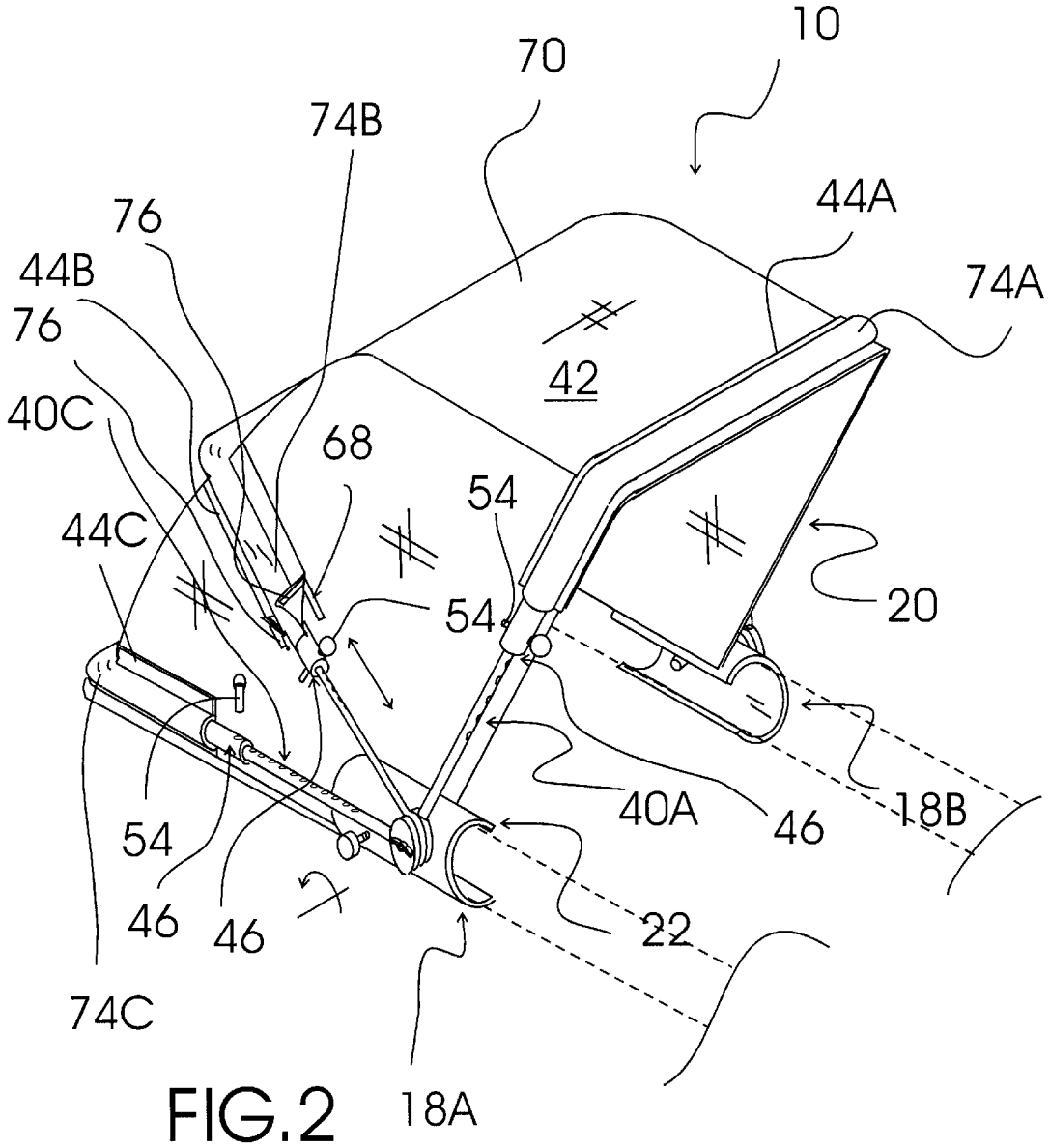
FIG. 2 is a detail perspective view of the exemplary medical transport cot collapsible canopy system showing the two cot rail connecting mechanisms and the canopy assembly including the three extendable length, U-shaped canopy supports, the stretchable fabric canopy member, and the three canopy member securing strips; each of the three U-shaped canopy supports having a U-shaped cross bar portion including a cross portion and two parallel oriented tubular end portions and two extendable length arms that are each slidably positionable into one of the two tubular end portions and lockable with respect thereto with a locking pin; each of the two extendable length arms terminating in a washer shaped fitting that is rotatably connected to the washer shaped fittings of the corresponding extendable length arms of the other two U-shaped canopy supports with a locking bolt assembly that includes a locking bolt having a shaft positionable through the washer shaped fittings and a nut threaded onto the shaft and tightenable sufficiently to lock the washer shaped fittings in fixed relation to each other; the stretchable fabric canopy member being constructed from a stretchable material and including three spaced hook and pile fastener strip pairs provided on the exterior surface thereof such that the U-shaped cross bar portion of each of the U-shaped canopy supports is positionable between one of the spaced hook and pile fastener strip pairs and securable in place with one of three canopy securing strips; each of the canopy securing strips having companionate hook and pile fastener strips provided along the side edges thereof that connect with the hook and pile fastener strips of the three spaced hook and pile fastener strip pairs such that each of the three canopy securing strips forms a canopy support receiving sleeve when connected to a hook and pile fastener strip pair; each of the two cot rail attachment mechanisms having a cot rail connecting mechanism and a flat connecting plate; the flat connecting plate being rotatably connected to the canopy assembly with the locking bolt assembly.

With reference to FIG. 2, collapsible canopy system 10 includes two cot rail connecting mechanisms, generally designated 18*a*,18*b*, and a canopy assembly, generally designated 20. Cot rail connecting mechanisms 18*a*,18*b* are mirror images of each other and each includes a cot rail connecting mechanism, generally designated 22, and, referring to FIG. 3, a flat connecting plate 24 having a connecting aperture 26 formed therethrough. Cot rail connecting mechanism 22 includes a tubular channel member 28 having a lateral rail insertion opening 30 provided along the entire length of an interior facing side thereof and defining a rail receiving channel 32 for receiving a section of the cot rail that is snap fit into rail receiving channel 32 of tubular channel member 28 through rail insertion opening 30 during installation. A rail locking screw 36 is threaded through an exterior sidewall of tubular channel member 28 that has an end 38 that is extendable into securing contact with a cot rail section positioned within rail receiving channel 32 during use. Flat connecting plate 24 extends outwardly from the exterior of tubular channel member 28.

Figure 2A:
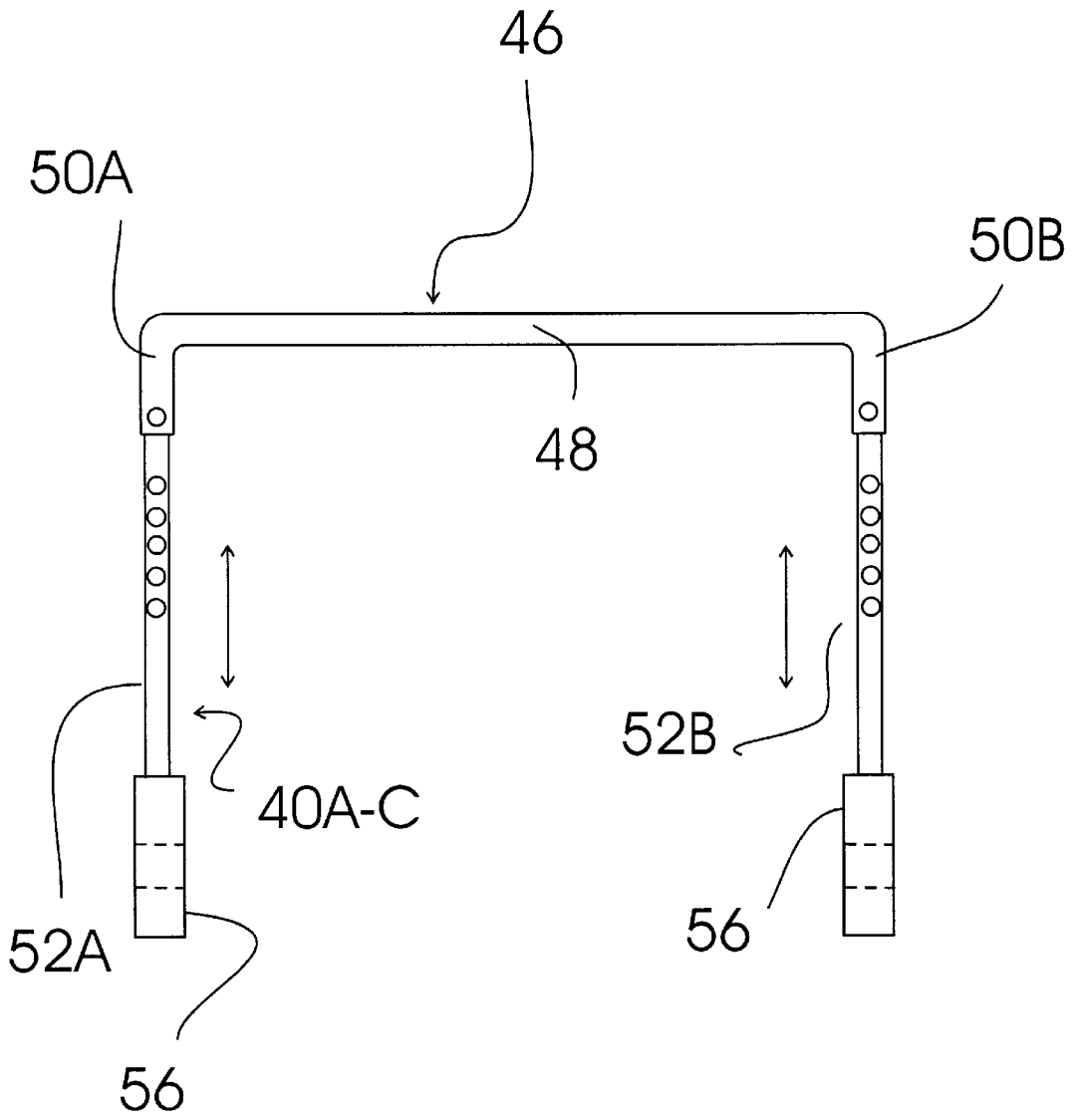
FIG. 2A is a front plan view of one of the three extendable length, U-shaped canopy supports showing the U-shaped cross bar portion including a cross portion and two parallel oriented tubular end portions and the two extendable length arms that are each slidably positionable into one of the two tubular end portions.
Figure 3:
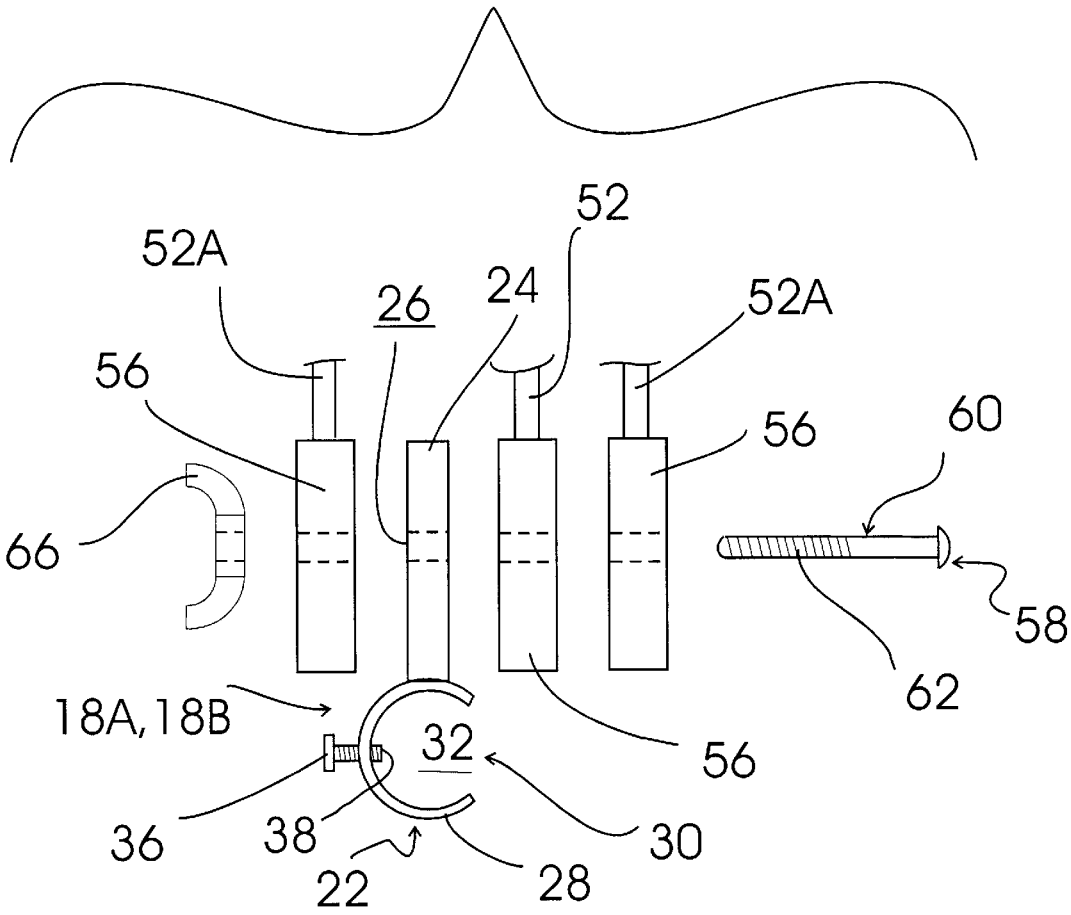
FIG. 3 is a front exploded plan view showing the wing nut of the locking bolt assembly, a first washer shaped fitting, one of the cot rail connecting mechanisms with the flat connecting plate positioned adjacent to the first washer shaped fitting, a second washer shaped fitting, a third washer shaped fitting, and the bolt of the locking bolt assembly; the bolt shaft being positionable through the concentrically aligned apertures of the first washer shaped fitting, the flat connecting plate, the second washer shaped fitting, and the third washer shaped fitting; the locking bolt assembly locking the first washer shaped fitting, the flat connecting plate, the second washer shaped fitting, and the third washer shaped fitting in fixed relation to each other by tightening the wing nut.

Referring back to FIG. 2, canopy assembly 20 includes three extendable length, U-shaped canopy supports, generally designated 40*a,*40*b,*40*c;* a stretchable fabric canopy member 42; and three canopy member securing strips 44*a,* 44*b,*44*c*. Referring to FIG. 2A, each of the three U-shaped canopy supports 40*a–c* has a U-shaped cross bar portion, generally designated 46 including a cross portion 48 and two parallel oriented tubular end portions 50*a,*50*b;* and two extendable length arms 52*a,*52*b* that are each slidably positionable, respectively, into a tubular end portion 50*a,*50*b* and lockable with respect thereto with a locking pin 54 (FIG. 2). Each of the two extendable length arms 52*a,*52*b* terminates in a washer shaped fitting 56 that, with reference to FIG. 3, is rotatably connected to the washer shaped fittings 56 of the corresponding extendable length arms 52*a* of the other two U-shaped canopy supports 40*a–c* with a locking bolt assembly, generally designated 58 that includes a locking bolt 60 having a shaft 62 positionable through washer shaped fittings 56 and flat connecting plate 24 and a wing nut 66 threaded onto the shaft 62 and tightenable sufficiently to lock the washer shaped fittings 56 and flat connecting plate 24 in fixed relation to each other.

Referring to FIG. 2, in this embodiment, stretchable fabric canopy member 42 is constructed from a lightweight spandex material and includes three spaced hook and pile fastener strip pairs 68 (only one shown) provided on the exterior surface 70 thereof such that U-shaped cross bar portion 46 of each of the U-shaped canopy supports 40*a–c* is positionable between one of the spaced hook and pile fastener strip pairs 68 and secured in place with one of three canopy securing strips 74*a–c*. Each of the canopy securing strips 74*a–c* has companionate hook and pile fastener strips 76 provided along the side edges thereof that connect with a spaced hook and pile fastener strip pair 68 such that each of the three canopy securing strips 74*a–c* forms a canopy support receiving sleeve when connected to a hook and pile fastener strip pair 68.

In use, the lengths of the three extendable length, U-shaped canopy supports 40*a,*40*b,*40*c* is easily adjusted when connected to stretchable fabric canopy member 42 because canopy member 42 stretches to accommodate the canopy supports. The length adjustment of each canopy support 40*a–c* is accomplished as described herein before. Canopy assembly 20 is extended to the desired degree from a collapsed configuration by loosening wing nut 66, positioning canopy support 40*a* to the desired position and then retightening wing nut 66. Canopy member 42 is easily replaced by removing the three canopy securing strips 74*a–c*. A new canopy member 42 can then be installed as described herein above.

It can be seen from the preceding description that a medical transport cot collapsible canopy system has been provided that is attachable to a medical transport cot; that is storable in a collapsed configuration and extendable when desired to partially or fully cover the head rest portion of the medical transport cot; that includes a canopy assembly that is adjustable in size; that includes a canopy assembly having a rapidly replaceable canopy member; and that includes two cot rail connecting mechanisms, each installable in connection with a bottom side rail of a medical transport cot, and a canopy assembly that is extendable from a collapsed configuration to provide a shield over a head rest portion of the medical transport cot; the canopy assembly including three extendable length, U-shaped canopy supports, a stretchable fabric canopy member, and three canopy member securing strips; each of the three U-shaped canopy supports having a U-shaped cross bar portion including a cross portion and two parallel oriented tubular end portions and two extendable length arms that are each slidably positionable into one of the two tubular end portions and lockable with respect thereto with a locking pin; each of the two extendable length arms terminating in a washer shaped fitting that is rotatably connected to the washer shaped fittings of the corresponding extendable length arms of the other two U-shaped canopy supports with a locking bolt assembly that includes a locking bolt having a shaft positionable through the washer shaped fittings and a nut threaded onto the shaft and tightenable sufficiently to lock the washer shaped fittings in fixed relation to each other; the stretchable fabric canopy member being constructed from a stretchable material and including three spaced hook and pile fastener strip pairs provided on the exterior surface thereof such that the U-shaped cross bar portion of each of the U-shaped canopy supports is positionable between one of the spaced hook and pile fastener strip pairs and securable in place with one of three canopy securing strips; each of the canopy securing strips having companionate hook and pile fastener strips provided along the side edges thereof that connect with the hook and pile fastener strips of the three spaced hook and pile fastener strip pairs such that each of the three canopy securing strips forms a canopy support receiving sleeve when connected to a hook and pile fastener strip pair; each of the two cot rail attachment mechanisms having a cot rail connecting mechanism in connection with a flat connecting plate; each cot rail connecting mechanism having a rail locking screw extendable into a rail receiving channel of the cot rail connecting mechanism for locking the cot rail attachment mechanism in a user selected position along a cot rail; the flat connecting plate being rotatably connected to the canopy assembly with the locking bolt assembly.

It is noted that the embodiment of the medical transport cot collapsible canopy system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A medical transport cot collapsible canopy system comprising:

two cot rail connecting mechanisms, each installable in connection with a bottom side rail of a medical transport cot; and a canopy assembly that is extendable from a collapsed configuration to provide a shield over a head rest portion of a medical transport cot;

said canopy assembly including three extendable length, U-shaped canopy supports, a stretchable fabric canopy member, and three canopy member securing strips;

each of said three U-shaped canopy supports having a U-shaped cross bar portion including a cross portion and two parallel oriented tubular end portions and two extandable length arms that are each slidably positionable into one of said two tubular end portions and lockable with respect thereto with a locking pin;

each of said two extendable length arms terminating in a washer shaped fitting that is rotatably connected to said washer shaped fittings of the corresponding extendable length arms of the remaining two said U-shaped canopy supports with a locking bolt assembly that includes a locking bolt having a shaft positionable through said washer shaped fittings and a nut threaded onto said shaft and tightenable sufficiently to lock said washer shaped fittings in fixed relation to each other;

said stretchable fabric canopy member being constructed from a stretchable material and including three spaced hook and pile fastener strip pairs provided on said exterior surface thereof such that said U-shaped cross bar portion of each of said U-shaped canopy supports is positionable between one of said spaced hook and pile fastener strip pairs and securable in place with one of three canopy securing strips;

each of said canopy securing strips having companionate hook and pile fastener strips provided along said side edges thereof that connect with said hook and pile fastener strips of said three spaced hook and pile fastener strip pairs such that each of said three canopy securing strips forms a canopy support receiving sleeve when connected to a hook and pile fastener strip pair;

each of said two cot rail attachment mechanisms having a cot rail connecting mechanism in connection with a flat connecting plate;

each cot rail connecting mechanism having a rail locking screw extendable into a rail receiving channel of said cot rail connecting mechanism for locking said cot rail attachment mechanism in a user selected position along a cot rail;

said flat connecting plate being rotatably connected to said canopy assembly with said locking bolt assembly.

* * * * *